US009445684B2

(12) United States Patent
Franssen

(10) Patent No.: US 9,445,684 B2
(45) Date of Patent: Sep. 20, 2016

(54) COVERING FOR AN ARCHITECTURAL OPENING

(71) Applicant: Hunter Douglas Industries B.V., Rotterdam (NL)

(72) Inventor: Johannes Robertus Maria Franssen, Breda (NL)

(73) Assignee: Hunter Douglas Industries B.V., Rotterdam (NL)

( * ) Notice: Subject to any disclaimer, the term of this patent is extended or adjusted under 35 U.S.C. 154(b) by 0 days.

(21) Appl. No.: 14/380,737

(22) PCT Filed: Feb. 28, 2013

(86) PCT No.: PCT/NL2013/000014

§ 371 (c)(1),
(2) Date: Aug. 25, 2014

(87) PCT Pub. No.: WO2013/129919

PCT Pub. Date: Sep. 6, 2013

(65) Prior Publication Data

US 2015/0034262 A1 Feb. 5, 2015

(30) Foreign Application Priority Data

Feb. 28, 2012 (NL) ..... 2008371

(51) Int. Cl.
*A47H 1/00* (2006.01)
*A47H 5/032* (2006.01)
(Continued)

(52) U.S. Cl.
CPC ..... *A47H 5/032* (2013.01); *A47H 23/00* (2013.01); *E06B 9/388* (2013.01); *E06B 2009/2625* (2013.01)

(58) Field of Classification Search
CPC ..... A47H 23/01; E06B 9/388; E06B 9/26; E06B 2009/2622; E06B 2009/2625; E06B 2009/2627; E06B 9/17046; E06B 9/367
USPC ..... 160/349.1
See application file for complete search history.

(56) References Cited

U.S. PATENT DOCUMENTS 2,649,151 A * 8/1953 Walker ..... E06B 9/305 160/178.1 R
3,280,890 A * 10/1966 Preziosi ..... A47H 3/08 160/168.1 R (Continued)

FOREIGN PATENT DOCUMENTS

DE 2304809 A1 8/1974
GB 2394746 A 5/2004

OTHER PUBLICATIONS

PCT Search Report for International Application No. PCT/NL2013/000014 dated Jun. 21, 2013, 4 pages.

*Primary Examiner* — Katherine Mitchell
*Assistant Examiner* — Johnnie A Shablack
(74) *Attorney, Agent, or Firm* — Dorsey & Whitney LLP

(57) ABSTRACT

A covering for an architectural opening comprising: a rail; a covering material, attached to said rail; at least two cords for guiding, supporting and/or lifting the covering material, the cords extending through the rail; and at least one weight disposed within the rail; characterised in that the rail comprises a longitudinally extending front portion, a longitudinally extending rear portion and a longitudinally extending central portion disposed between the front portion and the rear portion, and wherein said at least one weight is positioned at a location remote from the central portion.

23 Claims, 3 Drawing Sheets

(51) Int. Cl.

| | |
|---|---|
| ***E06B 9/388*** | (2006.01) |
| ***A47H 23/00*** | (2006.01) |
| *E06B 9/262* | (2006.01) |

(56) References Cited

U.S. PATENT DOCUMENTS 4,487,243 A * 12/1984 Debs ..... 160/168.1 R
5,127,458 A 7/1992 Schaefer et al.
5,176,192 A * 1/1993 Judkins et al. ..... 160/84.04
5,285,838 A * 2/1994 Rapp ..... E06B 9/303 160/168.1 R
5,320,154 A * 6/1994 Colson et al. ..... 160/121.1
6,062,292 A * 5/2000 Bryant ..... 160/178.1 R
6,095,222 A * 8/2000 Voss ..... 160/84.05
6,131,640 A 10/2000 Judkins
6,412,537 B1 * 7/2002 Voss et al. ..... 160/84.05
6,491,084 B2 * 12/2002 Voss et al. ..... 160/84.05
6,546,989 B2 * 4/2003 Coleman ..... E06B 9/388 160/173 R
6,758,258 B1 7/2004 Nien
6,769,471 B2 * 8/2004 Voss et al. ..... 160/84.05
6,845,806 B2 * 1/2005 Gottschall ..... E06B 9/42 160/238
6,910,517 B1 * 6/2005 Randall ..... E06B 9/326 160/178.1 R
6,962,186 B2 * 11/2005 Hsu ..... 160/84.04
7,178,576 B2 * 2/2007 Nien ..... E06B 9/303 160/168.1 R
7,562,689 B1 * 7/2009 Militello et al. ..... 160/84.04
7,832,450 B2 * 11/2010 Brace ..... E06B 9/262 160/168.1 R
8,230,896 B2 * 7/2012 Anderson ..... E06B 9/262 160/170
8,726,969 B2 * 5/2014 Lin ..... 160/108
8,789,575 B2 * 7/2014 Shih et al. ..... 160/84.06
8,931,540 B2 * 1/2015 Filko ..... 160/173 R
2005/0224191 A1 * 10/2005 Nien ..... 160/173 R
2006/0048904 A1 * 3/2006 Gruner ..... E06B 9/262 160/84.05
2007/0029052 A1 * 2/2007 Nien et al. ..... 160/84.05
2009/0032203 A1 * 2/2009 Liang ..... 160/178.1 R
2009/0205789 A1 * 8/2009 Watkins et al. ..... 160/173 R
2012/0097346 A1 * 4/2012 Ng ..... E06B 9/42 160/264
2015/0013921 A1 * 1/2015 Franssen ..... E06B 9/388 160/84.04
2015/0034262 A1 * 2/2015 Franssen ..... 160/349.1

* cited by examiner

COVERING FOR AN ARCHITECTURAL OPENING

CROSS-REFERENCE TO RELATED APPLICATIONS

This application is the national stage application of International Patent Application No. PCT/NL2013/000014, filed Feb. 28, 2013, entitled "A Covering For an Architectural Covering", which claims priority to Netherlands Patent Application No. 2008371, filed Feb. 28, 2012, entitled "A Covering For an Architectural Opening," which are hereby incorporated by reference herein in their entireties.

BACKGROUND OF THE INVENTION

The present invention relates to a covering for an architectural opening, and in particular a covering which requires extra weight to be incorporated into at least one of the rails of the covering.

It is known to add extra weight to a rail of a covering. This may for instance be done to provide extra stability for the rail, so as to prevent it from wobbling during raising and lowering.

Applying extra weight to a rail of a covering can also be advantageous in the case of, for example, pleated and/or honeycomb blinds to facilitate lowering of the blind. The extra weight helps to overcome the friction of the cords that run through the pleated and/or honeycomb material. At every hole in the fabric through which these cords pass, some friction is exerted on the cords by the edges of the holes. This friction increases as the material is extended. In a collapsed condition, the pleat/honeycomb material extends substantially perpendicular to the cords. Therefore, in this condition, the cords may not even contact the edges of the holes and the friction will be low. However, as the fabric extends, the angle between the pleat material and the horizontal may go from 0° to for instance 45° or 60° or more and in such cases, the edges of the holes will contact the cords and exert a frictional force thereon. The total friction will of course also increase with the height of the blind, as there will be more holes for the cords to pass through. Inserting extra weight into the lower rail of the blind will help to overcome this friction.

Typically, most rails have in essence two longitudinally extending side walls connected together by a central wall. The side walls and the central wall are usually an integral unit formed by extrusion. The edge of the fabric is disposed on one side of the central wall, and the cords (for lifting, guiding and/or supporting the covering material) may extend through the central wall to a cord chamber on the other side. After assembly, the cord chamber, which is bounded by the central wall and the side walls of the rail, may be closed with a cover which can be slid into grooves provided at the end of the side wall.

In known coverings, the weight is normally shaped as a metal bar. This bar is attached to the inner surface of the central wall, i.e. the surface that forms part of the boundary of the cord chamber. Known means of attaching the bar to the central wall include glue and other adhesives, double-sided tape, Velcro, for example.

This conventional way of applying extra weight, however, has several disadvantages. For example, during transport the weight may become dislodged and may start to slide in the rail. This may cause damage to end caps of the rail that will usually be mounted on either end of the rail. Furthermore, in conventional rails, the location of the weights may not be optimum. This is because the weights have to be positioned such that they do not interfere with the cords which enter the rail via holes in the central wall of the rail. Thus care has to be taken when mounting the weights so as to ensure that the weights do not obstruct the holes and/or the routing of the cords. Accordingly, the positioning freedom of the weights is limited. In some instances, the weights may even have to be cut to fit between adjacent holes. A further consequence is that the weights must be mounted at an early stage of assembly, in any case prior to assembling the cords, because if the weights are mounted afterwards, the cords may become trapped between the weight and the central wall of the rail. However, mounting the weights at such an early stage may be disadvantageous. For instance, an installer may only find out during installation of the blinds that the number of weights is insufficient, or the position of the weights is wrong. In conventional rails, it is difficult to add extra weights at a later stage and it is also difficult to adjust the position of the weights later if required.

SUMMARY

The present invention aims to alleviate the above problems.

According to the present invention there is provided a covering for an architectural opening comprising: a rail;

a covering material, attached to said rail;

at least two cords for guiding, supporting and/or lifting the covering material, the cords extending through the rail; and at least one weight disposed within the rail;

characterised in that the rail comprises a longitudinally extending front portion, a longitudinally extending rear portion and a longitudinally extending central portion disposed between the front portion and the rear portion, and wherein said at least one weight is positioned at a location remote from the central portion.

Preferably the rail comprises a plurality of chambers. Advantageously a first cord chamber for receiving the lift cords is provided within the rail, the cord chamber being at least partially bounded by the central portion of the rail.

The rail is preferably constructed such that it permits an edge of the fabric to be disposed on one side of the central portion, and the cord chamber is located on the other side of the central portion. The central portion has holes provided through it for receiving the cords which extend from the fabric through the holes in the central portion and into the cord chamber, where they may be routed towards and fixed to an adjuster, for example, such as the one disclosed in EP 0 892 144.

Advantageously, the weight is located in the second chamber, and the first cord chamber and the second chamber are constructed in a manner which acts to prevent the weight from entering the first cord chamber.

This advantageously prevents the weight from touching the cords and thereby hindering their function. Furthermore, by providing a second chamber for receiving the weight remote from the cord chamber, the location of the weight is no longer dependent on the position of the holes in the central portion and the position of the cords. This allows one or more weights to be optimally positioned. The length of the weight will also no longer be limited by the spacing between the holes.

In one embodiment of the invention, the front portion and the rear portion of the rail both comprise a rib which extends laterally from said longitudinally extending front and rear portions and which is located remote from the central portion. Ideally the weight is located between the rib of the front portion and the rib of the rear portion of the—rail. This permits the weight to be located along the longitudinal axis of the covering, to help to maintain stability of the rail when the covering is raised or lowered.

In another embodiment of the present invention, the weight is positioned adjacent one of said front portion and said rear portion. This results in the rail being imbalanced, in that the weight distribution between the front portion and the rear portion of the rail is no longer equal. This imbalance is advantageously used to correct an imbalance caused, for example, by adding a handle to the rail. If the handle is added to the front portion of the rail, a weight may be added to the rear portion to maintain stability of the rail.

The weight may be attached to the rail by means of an adhesive. Alternatively, the weight may be manufactured to a tolerance which permits an interference fit between the weight and the rail. Alternatively, the weight may be clamped in a desired position in the rail. The weight may comprise a bent rod which is inserted into the second chamber. Alternatively, the weight may comprise a spring rod which is bent prior to insertion into the second chamber and which, once inserted, acts to maintain the weight in position in the chamber by exerting pressure on the walls of the chamber. Alternatively, the weight may be provided with two projections, the first projection being for engaging the rib of the front portion of the rail and the second projection being for engaging the rib of the rear portion of the rail.

It is desirable, but not essential, that the weight is attached to the rail in a manner that readily allows it to be removed or readjusted.

The rail may be provided with a plurality of weights. Advantageously, a weight may be provided at each of the longitudinal ends of the rail.

The covering may be of a top down/bottom up type. Such coverings comprise a head rail and two moveable rails, a first rail (known as a top rail) being located in use above the second rail (known as a bottom rail). Advantageously, one or more weights may be disposed in either or both of these rails.

BRIEF DESCRIPTION OF THE DRAWINGS

The present invention will now be described with reference to the drawings, of which

DETAILED DESCRIPTION

Figure 1:
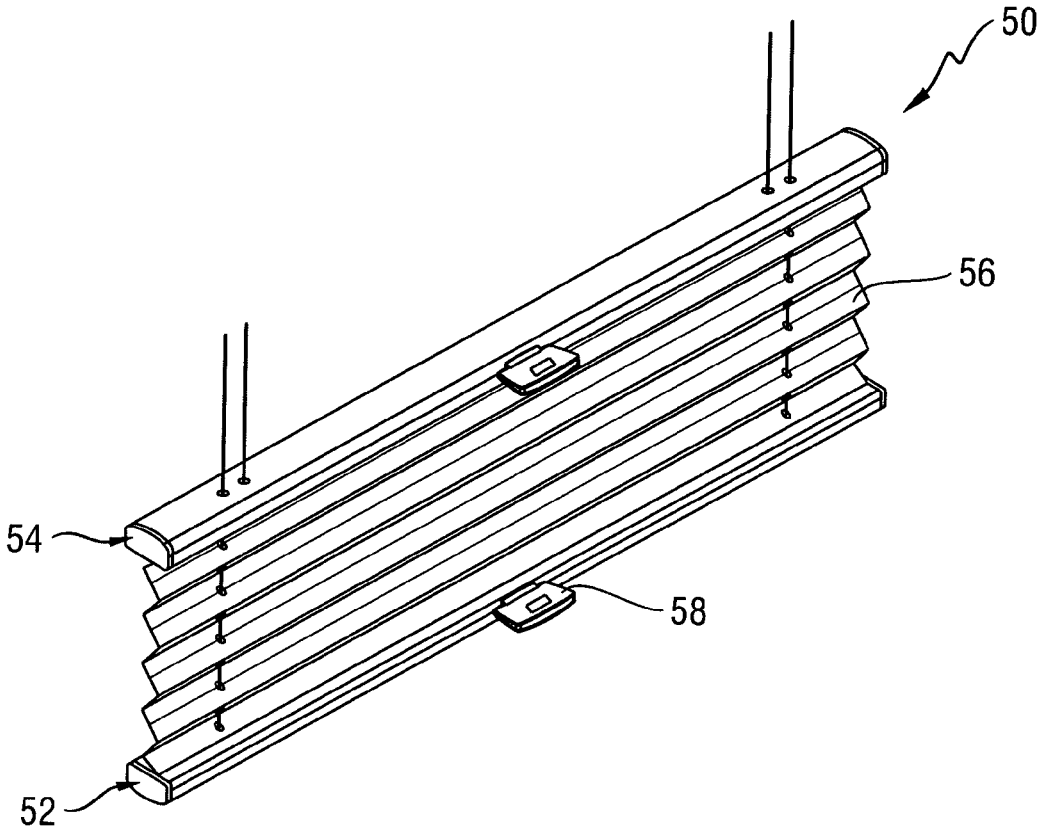
FIG. 1 shows an isometric external view of an architectural covering incorporating the invention.

Referring to FIG. 1, an architectural covering 50 having a bottom rail 52, a top rail 54 and a covering material, also referred to as covering member 56 extending between these rails 52,54 is illustrated. The covering material 56 may for instance be pleated material or honeycomb material. The top edge of the covering member 56 is secured to the top rail 54. The top rail 54 can be raised or lowered relative to a head rail (not shown). As the top rail 54 is raised, the covering member 56 is extended to cover more of the window. As the top rail 54 is lowered, the covering member 56 is retracted to uncover more of the window. Similarly, the bottom edge of the covering member 56 is secured to the bottom rail 52, and the bottom rail 52 can be raised or lowered to extend or retract the covering member 56. Accordingly, the covering member 56 can be extended or retracted to any desired degree between the two rails 52, 54. The top and bottom rail can be independently positioned at any desired location relative to each other. To facilitate manual movement of the top rail and the bottom rail, an optional handle 58 is provided on each rail. A weight is disposed within one or both of the rails, as described with reference to FIGS. 2-6*b*.

Figure 2:
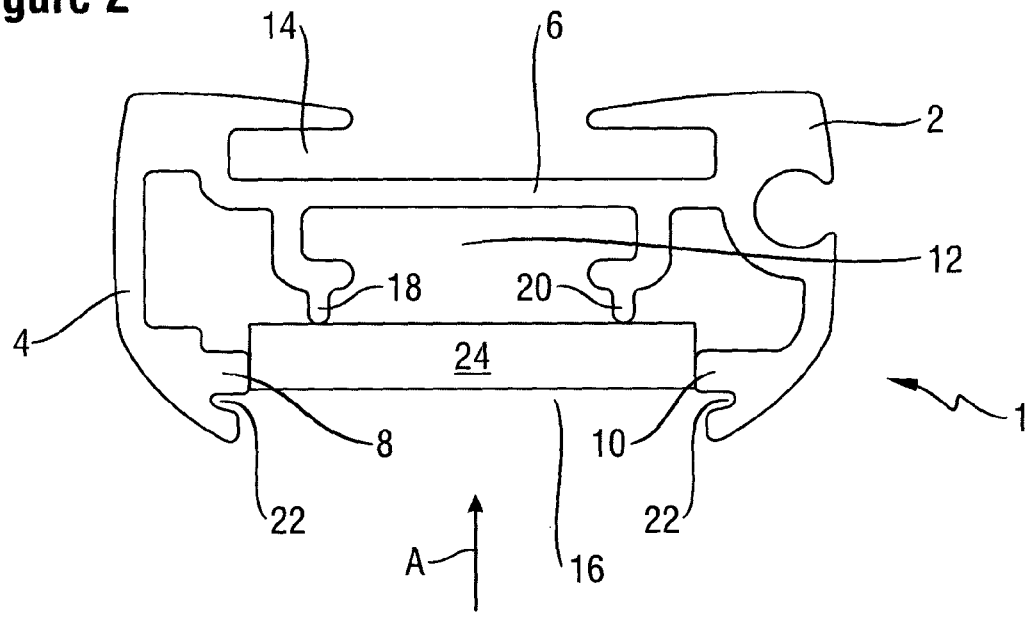
FIG. 2 shows a cross-section through a rail of a covering for an architectural opening in accordance with a first embodiment of the present invention.

A rail 1 (which may be a top rail 54 or a bottom rail 52) of a covering in accordance with the first embodiment of the present invention is shown in FIG. 2. The rail 1 comprises a rear portion 4, a front portion 2 and a central portion 6 which extends between the rear portion 4 and the front portion 2. All three portions extend longitudinally along the length of the rail and are formed integrally by extrusion. The top of the rail 1 has a groove 14 for receiving an edge of the covering material. On the other side of the central portion 6, a cord chamber 12 is provided. The covering may comprises at least two cords, e.g. for lifting and/or supporting the covering material. For each of the cords (not shown) a hole (not shown) is provided in the central portion 6 of the rail 1. This permits each cord to extend through the fabric down through the central portion 6 and into the cord chamber 12. Once in the cord chamber 12, the cords may be routed along some length of the rail, or be connected to some length adjustment means or tensioning means (not shown). Members 18, 20 extend perpendicular to the central portion 6 and also define the cord chamber 12. The lower edges of the rear portion 4 and the front portion 2 are provided with lateral ribs 8, 10 respectively. Thanks to such cantilevered arrangement the ribs may exhibit some resilience. A weight 24 is disposed between the ribs 8, 10 and is held in position by the ribs 8, 10. Preferably, the weight 24 is held in position through the resilient arrangement of the ribs 8, 10. Members 18 and 20 further act to prevent the weight 24, should it become loose, from entering the cord chamber 12. By preventing the weight 24 from entering the cord chamber 12, the weight 24 will not interfere with the cords. A groove 22 is provided on the lower edges of the rear portion 4 and the front portion 2. The groove 22 may serve to receive a cover (not shown).

During assembly, the cords are first directed through the holes in the central portion 6. The weight 24 is then inserted into the second chamber 16 and is held firmly in position by the ribs 8, 10. Once the weight has been located in the desired position, a cover (not shown) may be slid into grooves 22 to cover the bottom of the rail 1 along its longitudinal length, and to shield the weight 24 and the interior of the rail 1 from view.

Figure 3:
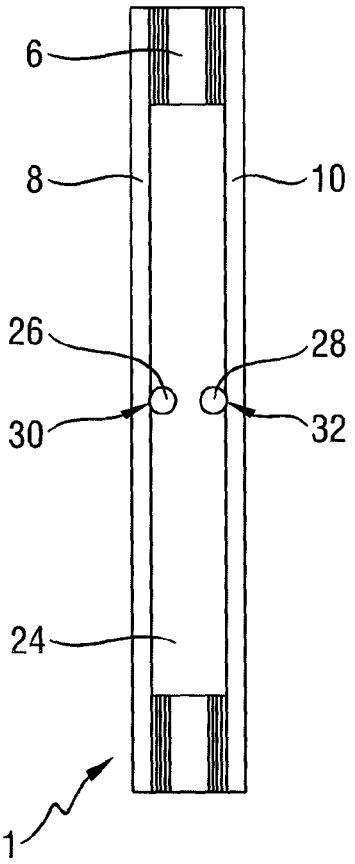
FIG. 3 shows a plan view looking in the direction of the arrow A of the rail of FIG. 2.
Figure 4:
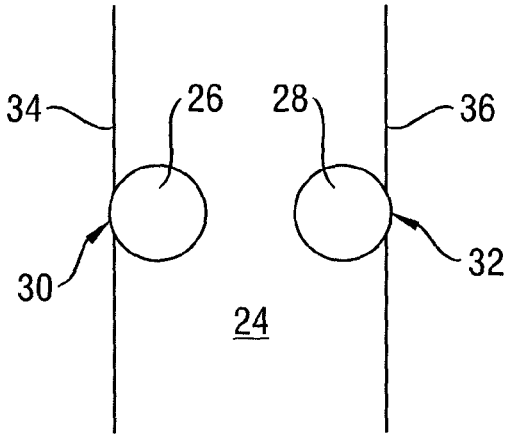
FIG. 4 shows a close-up view of part of the weight used in the rail of FIGS. 2 and 3.

FIG. 3 shows a plan view of the weight 24 located in the rail 1 of FIG. 2. This is the view that a user would see looking up at the underside of the rail 1, and is a portion of the rail near to one end of its longitudinal length. Ribs 8, 10 are holding weight 24 in position within the second chamber 16 of the rail 1. Projections 30, 32 are provided on the weight 24 for enabling the weight 24 to be tightly held in position by the ribs 8, 10. FIG. 4 shows the projections 30, 32 on the weight 24 in more detail. The projections may for instance be made by coining the surface of the weight 24 adjacent its edges 34, 36 so as to locally deform the material. Coining is a form of precision stamping in which the weight 24 is subjected to a sufficiently high stress to induce a deformation on the surface of the weight. A press is used to exert pressure at two locations 26, 28 located adjacent the edges 34, 36 on the surface of the weight 24. As a result of the pressure applied, tiny projections 30, 32 are formed and extend laterally, to give the surface of the bar a slightly greater width at the location where the projections are formed. The tiny projections 30, 32 permit a tight interference fit between the weights 24 and the ribs 8, 10 of the rail 1. Thus, the weight 24 is effectively clamped in position on the rail 1. If re-positioning of the weight is desired, this can be achieved by simply exerting a downward force on the weight sufficient to overcome the friction between the tiny projections 30, 32 and the ribs 8, 10 of the rail 1. In this manner the weight can be easily removed and re-positioned at another location along the length of the rail, if needed.

Generally, it is advantageous to provide two weights, one at either end of the rail. This improves the stability of the rail. Of course additional weights may be added to either end of the rail, or to the middle of the rail, or at any position along the rail, as may be required to achieve stability and to facilitate lowering of the blind.

Figure 5:
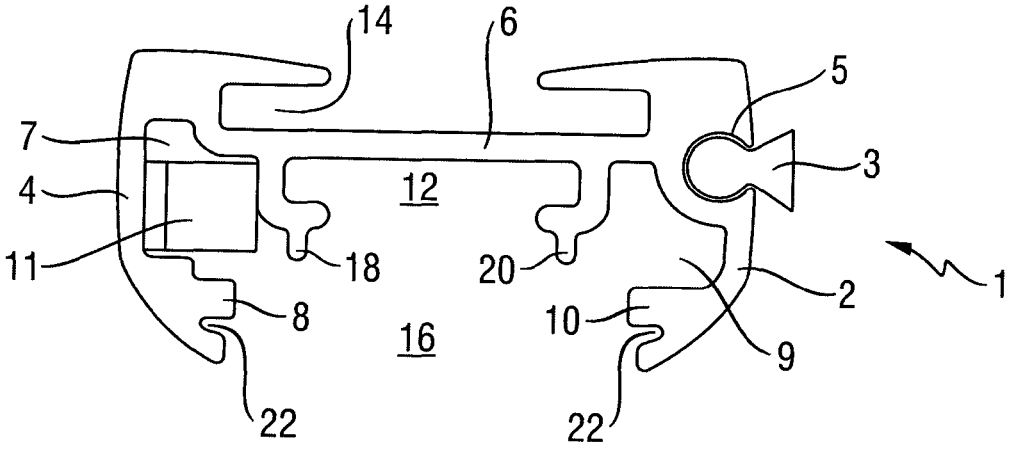
FIG. 5 shows a cross-section through a rail for a covering for an architectural opening in accordance with a second embodiment of the present invention.

FIG. 5 shows a rail which, in structure, is identical to the rail 1 shown in FIGS. 2 and 3. The rail 1 of FIG. 5 has a front portion 2, a rear portion 4 and a central portion 6 which connects the front portion 2 and rear portion 4. Central portion 6 has two members 18, 20 which extend downwardly and substantially perpendicular to the central portion 6. Central portion 6 and members 18, 20 define a cord chamber 12. As explained with reference to FIG. 2, central portion 6 includes holes (not shown) for receiving the cords (not shown). The rail 1 comprises a groove 14 for receiving an edge of the fabric (not shown). Once the covering is assembled, the fabric will be retained by groove 14 and the cords which extend through the fabric will pass through the holes located in the central portion 6 into the cord chamber 12. The cords will then extend longitudinally through the cord chamber and might be connected, for example, to an adjuster. In this embodiment, it is not desired that a weight be located along the longitudinal axis of rail 1 for maintaining stability. Rather, a weight 11 is provided in side chamber 7 as a counter-balance to handle 3 which is located in groove 5 of the front portion 2 of the rail 1. In some blinds and shades, it is desirable to provide a handle for allowing a user to manually adjust the position of the blind or shade. Where very lightweight handles are used, it may not be necessary to provide a counter-balance. However, for aesthetic reasons, it may sometimes be desirable to provide a heavier handle made for example of metal. Such a handle is heavy and may cause the rail to tilt around its longitudinal axis. This is clearly undesirable from an aesthetic point of view. Providing weight 11 at the opposite side of the rail from the handle, i.e. adjacent the rear portion 4, acts to counter-balance the weight of the handle and thereby prevent the rail from tilting around its longitudinal axis. To accommodate the weight 11, a side chamber 7 is provided, and is bounded by the rear portion 4 and the member 18 of the central portion 6. Similarly, another side chamber 9 may be provided on the front portion 2. In this case the side chamber 9 is bounded by the front portion 2 and the member 20 of central portion 6. The members 18, 20 and the lateral ribs 8, 10 act to prevent a weight 11 from falling out of the side chamber 7, 9 should it become dislodged. This ensures that the weight 11 is not able to enter the cord chamber 12 and interfere with the cords. As in FIG. 2, a groove 22 is provided on the lower end of rear portion 4 and on the lower end of front portion 2 for receiving a cover (not shown). The cover is adapted to be readily slid into the groove 22 and acts to shield the interior of the rail 1 from view.

The provision of a weight 11 in either of the side chambers 7, 9 may also be desirable when fabrics having an asymmetric cross-section are used in the covering. Some honeycomb-like fabrics have an asymmetric cross-section in that one side of the fabric is more or less straight when in an extended condition while the other side features half a honeycomb profile. This results in an asymmetric force on the rail, which tends to tilt the rail about its longitudinal axis. Again, this is clearly undesirable for aesthetic reasons. To counter-balance this effect, an additional weight may be applied to the opposite side of the rail.

Figure 6A:
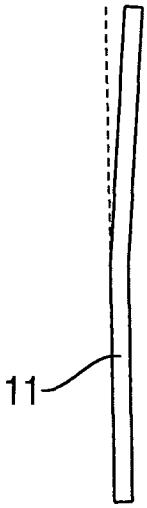
FIGS. 6*a* and 6*b* show a weight in the form of a rod suitable for use in the second embodiment of FIG. 5.
Figure 6B:
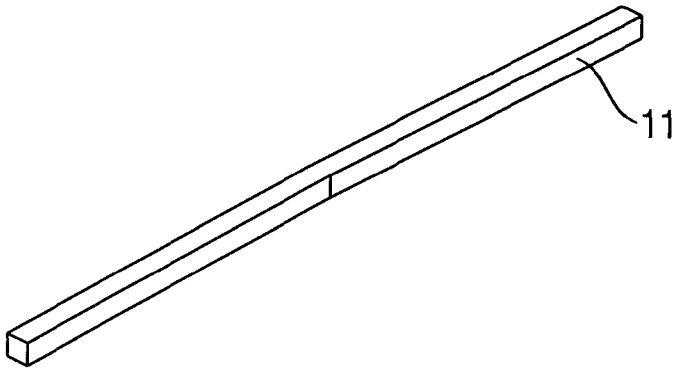

FIGS. 6*a* and 6*b* show a rod-shaped counter-balancing weight 11, suitable for use in the embodiment described in FIG. 5. The rods 11 are slightly bent, as can be seen from FIG. 6*a*, where the dotted lines represent the longitudinal axis of the rod, if it were straight. In use, the rod 11 may be urged into one of the side chambers 7, 9 on the side where the counter-balance is required. The rod can be inserted into the side chamber at either of the longitudinal ends of the rail, at whichever location the counter-balance is desired.

It will be recognised by persons skilled in the art that it would be perfectly possible to combine both of these embodiments, i.e. to provide a rail 1 which has a counter-balance weight 11 located in the side chamber 7 and furthermore has a separate weight 24 extending between the ribs 8, 10 as shown in FIG. 2. Such an arrangement can advantageously be used where a counter-balance is required and in addition extra weight is required to allow easy raising and lowering of the blind whilst maintaining stability.

Although the weights shown in these examples are of a substantially rectangular or square cross-section, it will be appreciated that weights having a different cross-section may equally be used in this invention. Also, the weights may be fixed in the rail 1 by adhesive means, rather than the clamping means described with respect to FIGS. 2 and 5. Similarly, other ways of clamping the weight in position in the rail, such as by providing sprung legs on one end of the weight, may be used instead. Clamping the weight in position has the advantage that the weight can be easily removed and remounted at another location along the length of the rail if required.

The chambers can be formed by providing ribs within the inner part of the rail, such as ribs 8, 10 or members 18, 20. Of course it will be appreciated that many other geometries are possible in addition to the one shown.

It will be recognised that the present invention may be incorporated in blinds having one moveable rail, or instead in blinds of the top down/bottom up variety. Such blinds comprise three rails, namely a head rail, a top rail and a bottom rail. It is envisaged that weights may be provided in either or both of the bottom and the top rail of a top down/bottom up blind.

It can be seen that the present invention advantageously allows weights to be positioned in one or more of the lower rails of a blind, without the risk of the weights interfering with the cords. Furthermore, freedom of assembly of the blind is enhanced. The weights can easily be mounted after assembly of the cords and may even be mounted after transport, at the installation site. Also if the number of weights is insufficient, adding extra weights is easy, as is the re-positioning of weights already installed.

The invention claimed is:

1. A covering for an architectural opening comprising:

a rail comprising a longitudinally extending front portion, a longitudinally extending rear portion, and a longitudinally extending central portion disposed between the front portion and the rear portion, the rail defining a plurality of chambers including a first chamber and a second chamber;

a covering material attached to the rail, wherein the covering material is disposed on a first side of the central portion of the rail, and the first and second chambers are disposed on a second side of the central portion opposite the first side;

at least two cords for performing at least one of guiding, supporting, or lifting the covering material, the at least two cords extending through the central portion of the rail and into the first chamber; and at least one weight disposed within the second chamber of the rail;

wherein the at least one weight is positioned at a location remote from the central portion of the rail so that the at least one weight is prevented from interfering with the at least two cords.

2. The covering as claimed in claim 1, wherein the first chamber is at least partially bounded by the central portion of the rail.

3. The covering as claimed in claim 1, wherein the second chamber is at least partially bounded by one of the front portion and the rear portion.

4. The covering as claimed in claim 1, wherein the first and second chambers are constructed in a manner which acts to prevent the at least one weight from entering the first chamber.

5. The covering as claimed in claim 1, wherein the second chamber is open towards the first chamber such that the at least two cords in the first chamber are accessible via the second chamber.

6. The covering as claimed in claim 1, wherein the at least one weight is resiliently held between cantilevered ribs of the rail.

7. The covering as claimed in claim 1, wherein the at least one weight is positioned adjacent one of the front portion and the rear portion.

8. The covering as claimed in claim 1, wherein the at least one weight is attached to the rail through an interference fit.

9. The covering as claimed in claim 1, wherein the at least one weight is clamped in a desired position on the rail.

10. The covering as claimed in claim 1, wherein the at least one weight comprises a sprung rod which is bent prior to insertion into the second chamber of the rail.

11. The covering as claimed in claim 1, wherein:

the at least one weight includes at least two weights; and the at least two weights are positioned at respective locations remote from the central portion.

12. The covering as claimed in claim 1, wherein the plurality of chambers includes a third chamber and a fourth chamber provided at opposite sides of the first chamber.

13. The covering as claimed in claim 12, wherein the third and fourth chambers are at least partially bounded by the central portion and further at least partially bounded by either the rear portion or the front portion of the rail.

14. The covering as claimed in claim 12, wherein at least one of the third chamber or the fourth chamber is open towards the second chamber.

15. The covering as claimed in claim 1, wherein the front portion and the rear portion are each at their inward facing side provided with a rib extending laterally from the front and rear portions at a distance from the central portion.

16. The covering as claimed in claim 15, wherein the at least one weight is located between the ribs of the front and rear portions of the rail.

17. The covering as claimed in claim 15, wherein the at least one weight is provided with two projections, a first projection for engaging the rib of the front portion of the rail and a second projection for engaging the rib of the rear portion of the rail.

18. A covering for an architectural opening, comprising:

a rail;

a covering material attached to the rail;

at least two cords associated with the covering material and extending through the rail; and at least one weight disposed within the rail through an opening in a portion of the rail and the at least two cords are accessible through the opening; wherein:

the rail comprises a longitudinally extending front portion, a longitudinally extending rear portion, and a longitudinally extending central portion disposed between the front portion and the rear portion; and the at least one weight is positioned at a location remote from the central portion and is repositionable along a length of the rail to alter a weight distribution of the rail.

19. The covering as claimed in claim 18, wherein the rail includes a groove on each of the front and rear portions operable to receive a cover member to conceal the at least one weight from view.

20. The covering as claimed in claim 18, wherein:

the rail includes a first chamber defined at least partially by elongate members extending downwardly from the central portion, the elongate members disposed between the front portion and the rear portion of the rail; and the at least two cords are located at least partially in the first chamber.

21. The covering as claimed in claim 20, wherein leading edges of the elongate members abut the at least one weight to locate the at least one weight within a second chamber of the rail.

22. The covering as claimed in claim 18, wherein the at least one weight is positioned on one side of the rail.

23. The covering as claimed in claim 22, wherein the at least one weight is positioned opposite of a handle attached to the rail.

* * * * *